US007560633B1

(12) United States Patent
Wang

(10) Patent No.: US 7,560,633 B1
(45) Date of Patent: Jul. 14, 2009

(54) ADJUSTABLE STAND FOR PERCUSSION INSTRUMENT

(76) Inventor: Wei-Pin Wang, P.O. Box 44-2049, Taipei (TW) 10668

( * ) Notice: Subject to any disclaimer, the term of this patent is extended or adjusted under 35 U.S.C. 154(b) by 0 days.

(21) Appl. No.: 12/081,053

(22) Filed: Apr. 10, 2008

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS

| | | | | |
|---|---|---|---|---|
| 4,141,272 | A * | 2/1979 | Yanagisawa | 84/421 |
| 4,747,569 | A * | 5/1988 | Hoshino | 248/291.1 |
| 6,054,645 | A * | 4/2000 | Gauger | 84/422.3 |
| 6,096,956 | A * | 8/2000 | Hoshino | 84/421 |
| 6,259,011 | B1 * | 7/2001 | Liao | 84/421 |
| 6,307,137 | B1 * | 10/2001 | Liao | 84/422.3 |
| 6,659,417 | B2 * | 12/2003 | Hsieh | 248/404 |
| 6,838,602 | B2 * | 1/2005 | Chang | 84/327 |
| 7,040,831 | B2 * | 5/2006 | Rapaport | 403/84 |
| 7,395,994 | B1 * | 7/2008 | Sikra | 248/229.1 |
| 7,423,211 | B2 * | 9/2008 | Hsieh | 84/421 |
| 2003/0005809 | A1 * | 1/2003 | Hsieh | 84/421 |
| 2005/0120864 | A1 * | 6/2005 | Takegawa | 84/421 |

* cited by examiner

*Primary Examiner*—Jeffrey Donels
*Assistant Examiner*—Robert W Horn

(57) ABSTRACT

An adjustment stand includes a first block and a second block which are pivotably connected at two respective top ends thereof and an urging member is engaged with the second block by a bolt which extends through the two blocks and is connected with a nut. A transverse hole is defined transversely between the first and second blocks and a shaft extends through the transverse hole. A connection rod extends through the shaft and is connected to a percussion instrument. The first block has an insertion hole and a support rod is inserted into the insertion hole. A side hole is defined in the first block and communicates with the insertion hole. The urging member includes a semi-circular recess which is in contact with the support rod via the side hole. By loosening the bolt, the shaft and the first block can be pivoted about two perpendicular axes.

9 Claims, 6 Drawing Sheets

ADJUSTABLE STAND FOR PERCUSSION INSTRUMENT

BACKGROUND OF THE INVENTION (1) Field of the Invention

The present invention relates to an adjustable stand for percussion instrument and more particularly, to a stand capable of adjusting in two directions by loosing one bolt.

(2) Description of the Prior Art

A conventional stand for music instrument such as percussion instrument generally includes an adjustment collar and a fixed collar which includes a tubular portion so as to receive a part of the instrument. A central hole is defined in the fixed collar and a plurality teeth projecting from a side of the fixed collar. The adjustment collar includes another central hole and an open recess which includes teeth defined therein such that a toothed block can be locked with the teeth in the open recess. A connection rod is connected to the adjustment collar so as to be connected with the percussion instrument. When the adjustment collar and the fixed collar are fixedly connected to each other, a locking member extends through the two central holes so connect the two collars. When adjusting the instrument, the locking member is slightly loosened and the adjustment collar together with the connection rod are pivoted to a desired angular position.

It is noted that when adjusting the adjustment collar, the weight of the instrument might drag the adjustment collar and even separate the two collars. Besides, the conventional stand can only adjust the instrument in vertical direction and cannot adjust in horizontal direction.

The present invention intends to provide an adjustable stand for percussion instrument and the adjustment stand is capable of adjusting in two directions by loosing only one bolt.

SUMMARY OF THE INVENTION

The present invention relates to an adjustment stand for percussion instrument and the stand comprises a main part composed of a first block, a second block and an urging member. A transverse hole is defined transversely between the first and second blocks so that a shaft extends through the transverse hole. The shaft is connected with a connection rod which is connected with a percussion instrument. The first block has an insertion hole defined axially in an underside thereof and a support rod is inserted into the insertion hole. A side hole is defined in the first block and communicates with the insertion hole. The second block includes a notch defined in an outside thereof and the urging member is engaged with the notch and the side hole to position the support rod. A locking device adjusts the urging member so as to adjust the shaft and the support rod.

The primary object of the present invention is to provide an adjustment stand for percussion instrument and the instrument can be adjusted in horizontal and vertical directions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1A:
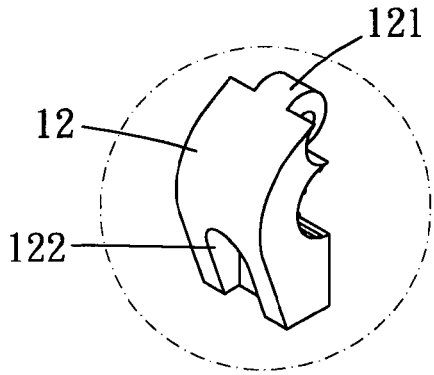
FIG. 1 is an exploded view to show the adjustable stand for percussion instrument of the present invention.
Figure 1:
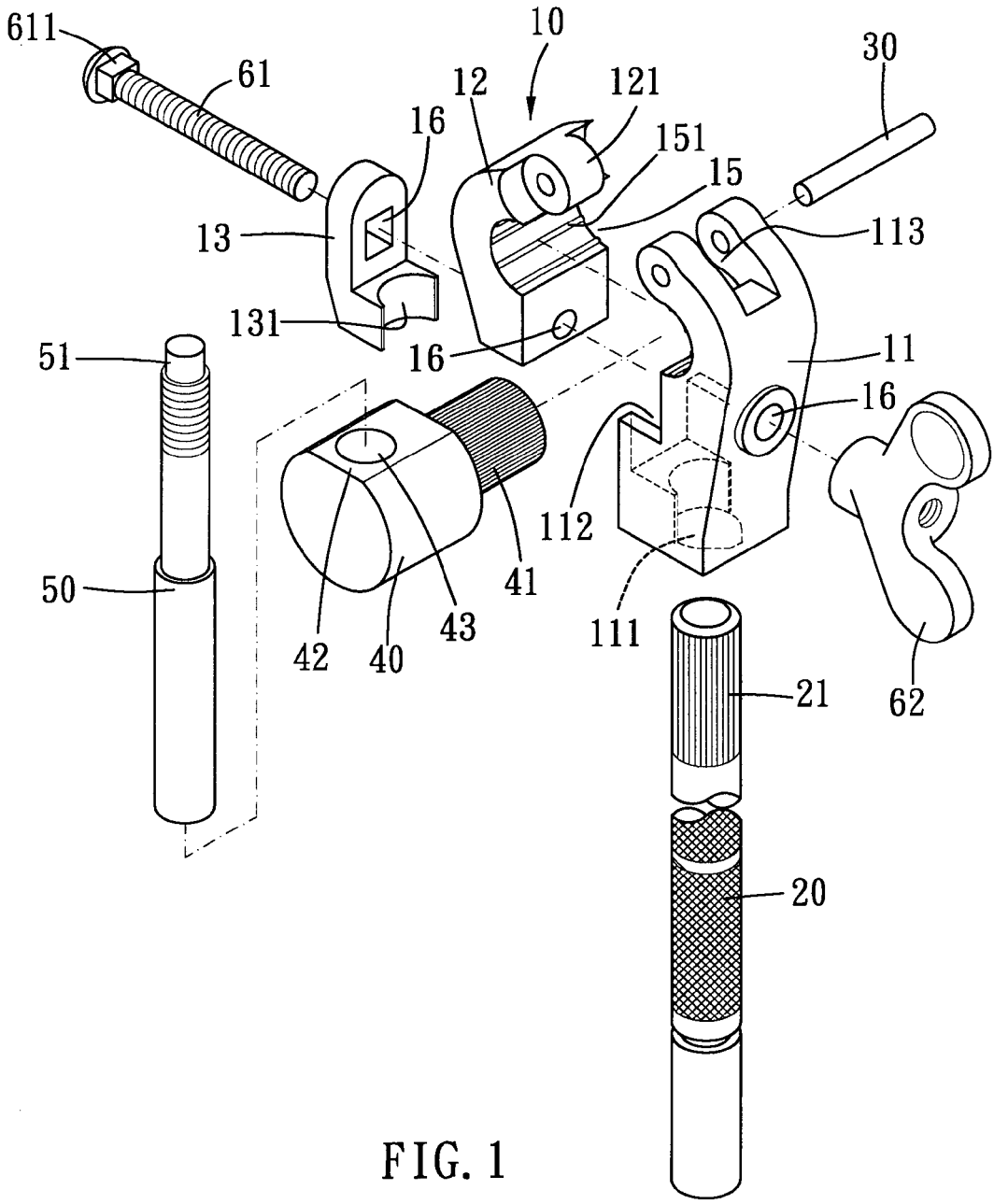
Figure 2:
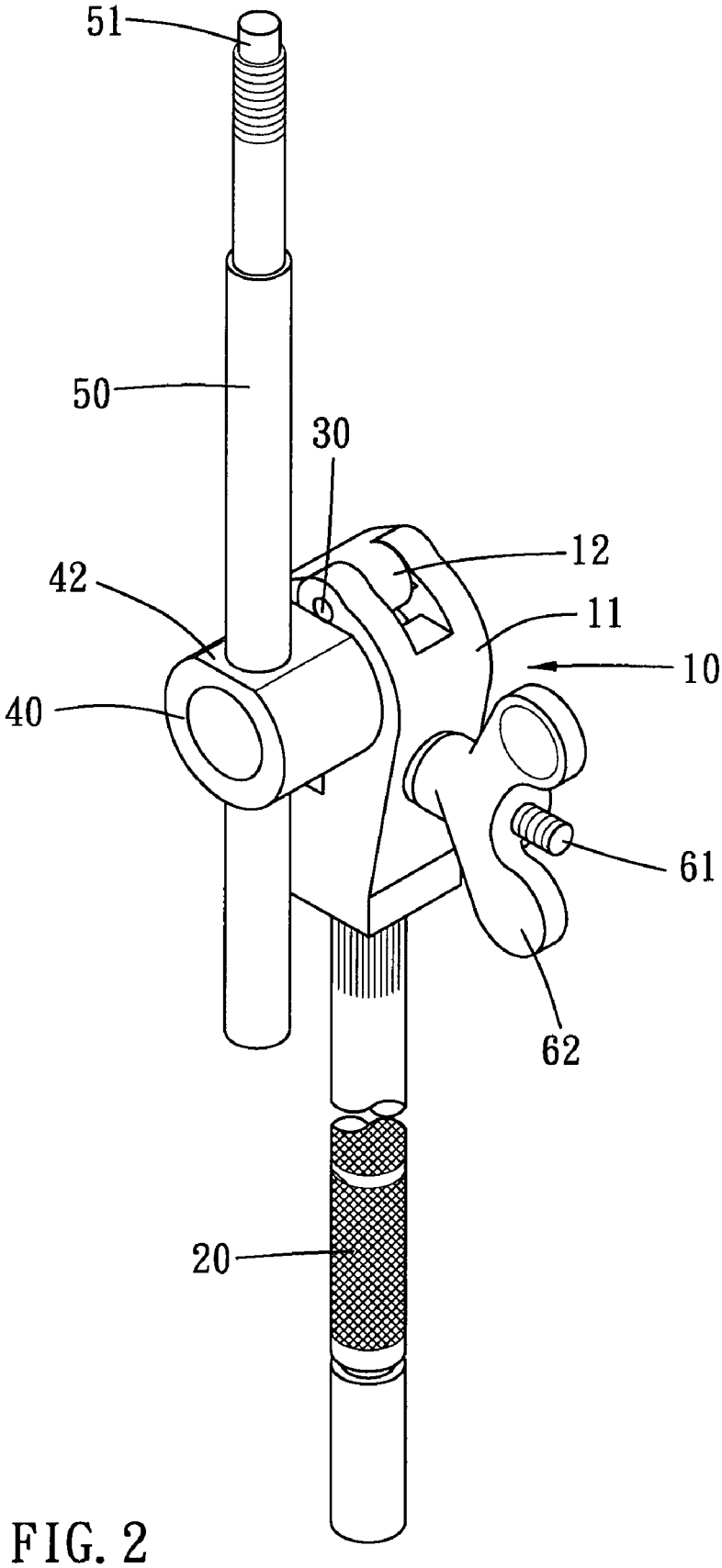
FIG. 2 is a perspective view to show the adjustable stand for percussion instrument of the present invention.
Figure 3:
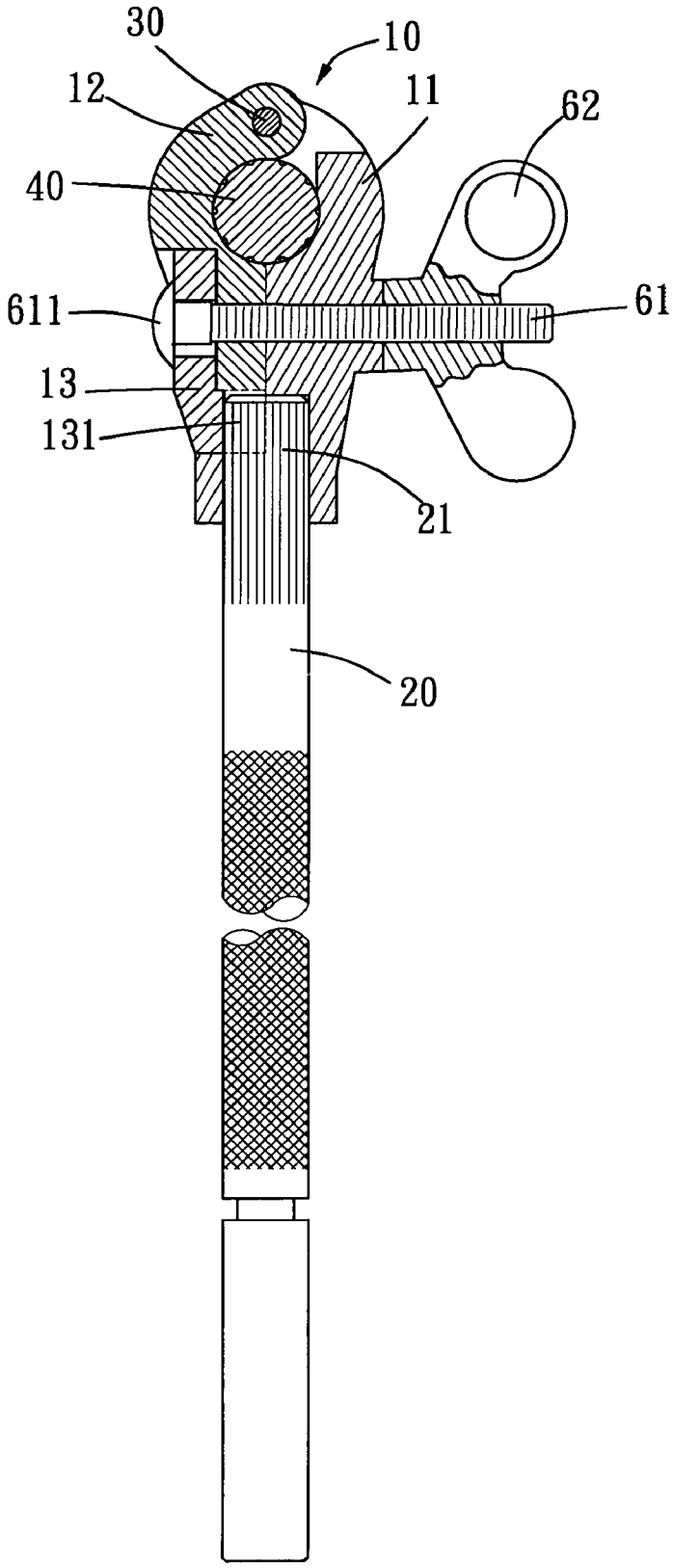
FIG. 3 is a cross sectional view to show the adjustable stand for percussion instrument of the present invention.
Figure 6:
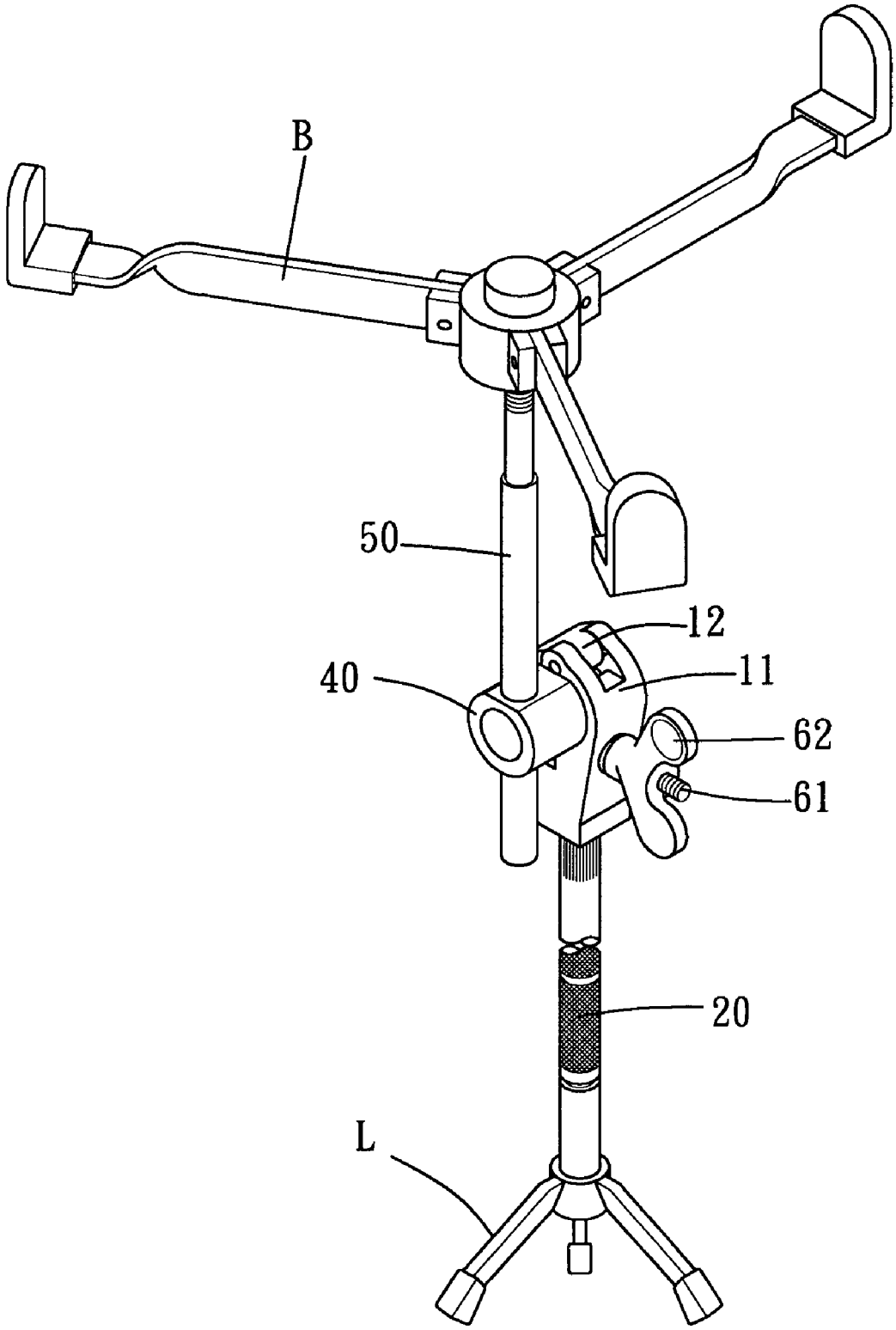
FIG. 6 shows that the adjustable stand for percussion instrument of the present invention is connected with a leg unit and a drum support frame.

Referring to FIGS. 1 to 3, the adjustable stand for percussion instrument of the present invention comprises a main part 1 which is composed of a first block 11, a second block 12 and an urging member 13. The first and second blocks 11, 12 are pivotably connected to each other at two respective top ends thereof by extending a pin 30 through the two respective top ends. The first block 11 includes a recess 113 defined in the top end thereof and the second block 12 includes an insertion 121 which is pivotably engaged with the recess 113 by the pin 30. The first block 11 has an insertion hole 111 defined axially in an underside thereof and a support rod 20 is inserted into the insertion hole 111. The support rod 20 includes a toothed surface 21 which is located in the insertion hole 111. A side hole 112 is defined in the first block 11 and communicates with the insertion hole 111. The second block 12 includes a notch 122 defined in an outside thereof, the urging member 13 is engaged with the notch 122 and includes a semi-circular recess 131 with which the support rod 20 is partially enclosed. The support rod 20 is connected with a leg unit "L" as shown in FIG. 6.

A transverse hole 15 is defined transversely between the first and second blocks 11, 12, and a plurality of ridges 151 extend axially from an inner periphery of the transverse hole 15. A shaft 40 extends through the transverse hole 15 and includes axial toothed surface 41 which is engaged with the ridges 151. Two through holes 16 are respectively defined through the urging member 13 and the first block 11. A locking device includes a bolt 61 and a nut 62, the bolt 61 extends through the through holes 16 and is threadedly connected with the nut 62.

The shaft 40 includes a flat surface 42 and a passage 43 is defined through the shaft 40 and the flat surface 42. A connection rod 50 extends through the passage 43 in the shaft 40 and a percussion instrument "M" or a drum support frame "B" is connected to an end portion 51 of the connection rod 50 as shown in FIG. 4 or 6.

Figure 4:
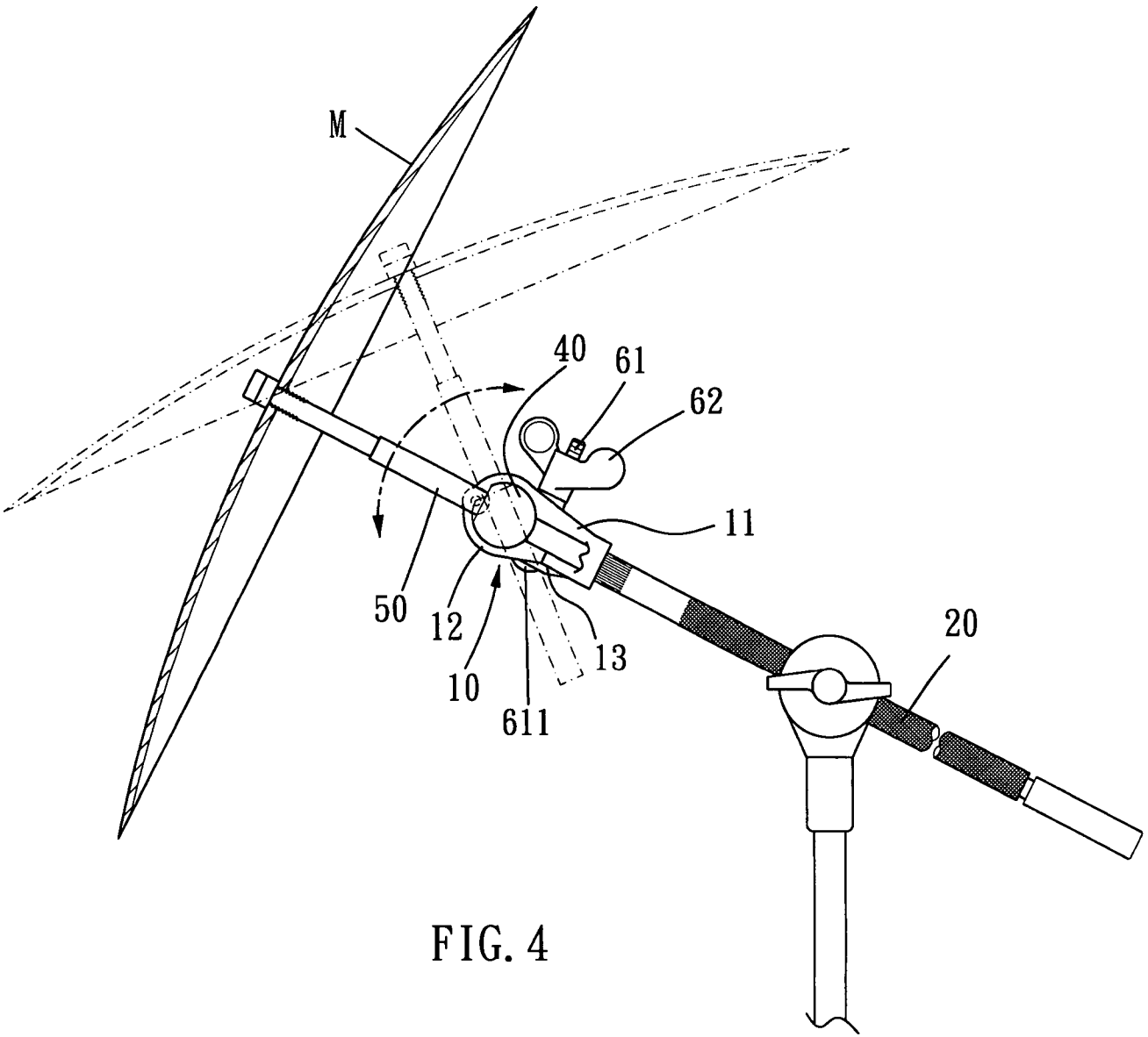
FIG. 4 shows that the shaft together with the connection rod are pivoted.
Figure 5:
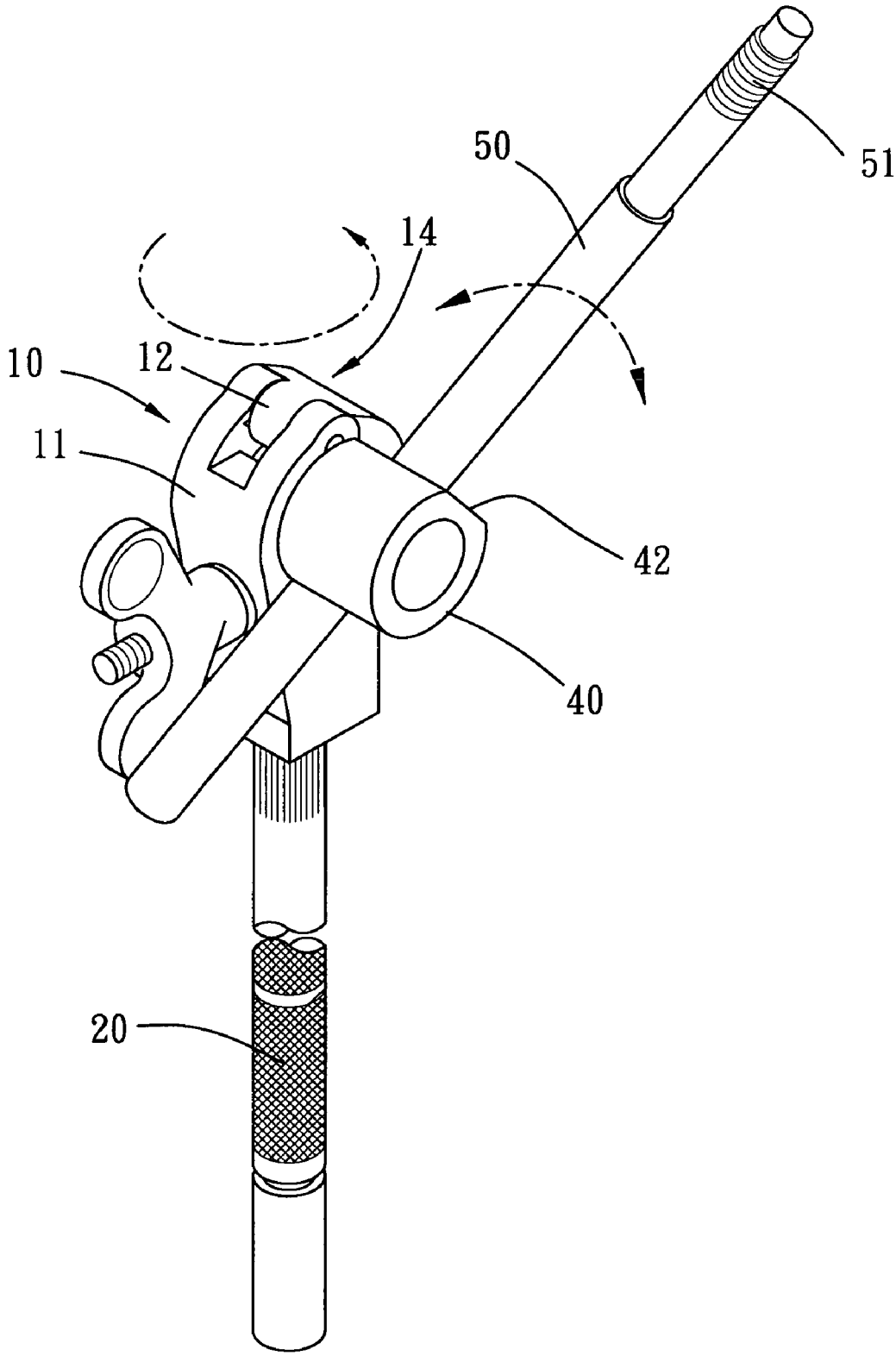
FIG. 5 shows that the main part is pivoted horizontally.

When adjusting the stand, the user simply rotates the nut 62 to loosen the bolt 61, the head 611 of the bolt 61 is moved in a direction away from the nut 62 so that the shaft 40 can be rotated about the axis thereof as shown in FIG. 4, the connection rod 50 together with the percussion instrument "M" is adjusted in vertical direction. The range of the adjustment can be 360 degrees. The support rod 20 can also be rotated to adjust the main part 10 in horizontal direction as shown in FIG. 5. The range of the adjustment can be 360 degrees.

When the percussion instrument "M" and the drum support frame "B" are adjusted to desired angular positions, the nut 62 is tightly connected to the bolt 61 to secure the positions.

The shaft 40 and the support rod 20 are both securely positioned by the urging member 13 and either of the shaft 40 and the support rod 20 can be adjusted simply by loosening the bolt 61. The percussion instrument "M" and the drum support frame "B" can be adjusted in two different directions which satisfy most needs of the users.

While we have shown and described the embodiment in accordance with the present invention, it should be clear to those skilled in the art that further embodiments may be made without departing from the scope of the present invention.

What is claimed is:

1. An adjustment stand for percussion instrument, comprising:

a main part comprising a first block, a second block and an urging member, a transverse hole defined transversely between the first and second blocks, a shaft extending through the transverse hole, the first block having an insertion hole defined axially in an underside thereof and a support rod inserted into the insertion hole, a side hole defined in the first block and communicating with the insertion hole, the second block including a notch defined in an outside thereof, the urging member engaged with the notch and the side hole, and a locking device adjusting the urging member to the second block and the support rod so as to adjust the shaft and the support rod.

2. The stand as claimed in claim 1, wherein the locking device includes a bolt and a nut, two through holes are respectively defined through the urging member and the first block, the bolt extends through the through holes and is threadedly connected with the nut.

3. The stand as claimed in claim 1, wherein the first and second blocks are pivotably connected to each other at two respective top ends thereof by extending a pin through the two respective top ends.

4. The stand as claimed in claim 3, wherein the first block includes a recess defined in the top end thereof and the second block includes an insertion which is pivotably engaged with the recess by the pin.

5. The stand as claimed in claim 1, wherein the transverse hole includes ridges extending axially from an inner periphery thereof and the shaft has axial toothed surface which is engaged with the ridges.

6. The stand as claimed in claim 1, wherein the support rod includes a toothed surface.

7. The stand as claimed in claim 1, wherein a connection rod extends through the shaft and a percussion instrument is connected to the connection rod.

8. The stand as claimed in claim 1, wherein the support rod is connected with a leg unit.

9. The stand as claimed in claim 1, wherein the urging member includes a semi-circular recess with which the support rod is partially enclosed.

* * * * *